US006708733B2

(12) United States Patent
Iizuka

(10) Patent No.: US 6,708,733 B2
(45) Date of Patent: Mar. 23, 2004

(54) WOVEN BAND FOR ATTACHING ONTO VARIOUS PORTIONS OF USERS

(75) Inventor: Yukari Iizuka, Tokyo (JP)

(73) Assignee: Yu Tze Gien, Taiwan (CN); part interest ( * ) Notice: Subject to any disclaimer, the term of this patent is extended or adjusted under 35 U.S.C. 154(b) by 155 days.

(21) Appl. No.: 10/151,205

(22) Filed: May 16, 2002

(65) Prior Publication Data

US 2002/0189300 A1 Dec. 19, 2002

(30) Foreign Application Priority Data

May 23, 2001 (TW) ..... 90208435 U

(51) Int. Cl.[7] ..... D03D 3/02

(52) U.S. Cl. ..... 139/383 B

(58) Field of Search ..... 139/383 B, 387 R, 139/388, 410; 66/190, 169 R, 170, 171, 173; 442/305

(56) References Cited

U.S. PATENT DOCUMENTS

| | | | | | |
|---|---|---|---|---|---|
| 3,184,758 | A | * | 5/1965 | Hirsch | 2/209 |
| 3,580,295 | A | * | 5/1971 | Jisa et al. | 139/383 R |
| 3,880,202 | A | * | 4/1975 | Mohelnicky et al. | 139/383 R |
| 4,843,653 | A | * | 7/1989 | Coble | 2/170 |
| 5,285,661 | A | * | 2/1994 | Mathieu | 66/9 R |
| 5,592,977 | A | * | 1/1997 | Kikuchi et al. | 139/387 R |
| 5,823,012 | A | * | 10/1998 | Hacskaylo | 66/171 |
| 6,277,011 | B1 | * | 8/2001 | Moreillon | 451/326 |

* cited by examiner

*Primary Examiner*—Danny Worrell
(74) *Attorney, Agent, or Firm*—Charles E. Baxley

(57) ABSTRACT

A woven band includes a prototype having an outer peripheral layer and an inner peripheral layer and each having two end portions woven and coupled continuously with each other. The inner peripheral layer includes a woven pattern disposed and formed in the middle portion. The outer peripheral layer includes a middle portion having a knitting coupled between the end portions. The inner peripheral and the pattern may be exposed, and the outer peripheral layer may be received in the inner peripheral layer when the prototype of the woven band is turned inside out.

1 Claim, 2 Drawing Sheets

WOVEN BAND FOR ATTACHING ONTO VARIOUS PORTIONS OF USERS

BACKGROUND OF THE INVENTION

1. Field of the Invention

The present invention relates to a knitting or a woven band, and more particularly to a knitting or a woven band for attaching onto various portions of the users.

2. Description of the Prior Art

Typical woven bands may be provided for attaching onto the wrist portions, the leg portions or the like of the users, and normally comprise a cylindrical shape including an inner peripheral layer and an outer peripheral layer made or woven separately, and then having the end portions secured together with stitches or by knittings. Accordingly, a number of working or manufacturing processes, and a large amount of labor works are required for manufacturing the woven bands, such that the woven bands may not be manufactured or made in mass production.

In addition, the end portions of the inner and outer peripheral layers, that are required to be secured together with stitches or by knittings, may include a non-continuous coupling portions, and may spoil the outer appearance of the woven band. Furthermore, a number of materials are required to be cut and wasted while manufacturing the inner and the outer peripheral layers separately.

The present invention has arisen to mitigate and/or obviate the afore-described disadvantages of the conventional woven bands.

SUMMARY OF THE INVENTION

The primary objective of the present invention is to provide a woven band including an inner and an outer peripheral layers that are not required to be secured together with stitches or by knittings in the outer end portions, and that include continuous coupling end portions, for allowing the woven band to have a continuous and beautiful outer appearance.

The other objective of the present invention is to provide a woven band including an inner and an outer peripheral layers having continuous coupling end portions, for allowing the woven band to be made in a single weaving process, without cutting and wasting much thread materials.

The further objective of the present invention is to provide a woven band that may be made into various kinds of sizes or diameters or heights for engaging onto various portions of the users, such as the hands, the wrists, the legs, the ankles, the heads, etc.

In accordance with one aspect of the invention, there is provided a woven band comprising a first peripheral layer including a first end portion and a second end portion, and a second peripheral layer disposed in the first peripheral layer, and including a first end portion and a second end portion, woven and coupled continuously with the first end portion and the second end portion of the first peripheral layer respectively, and including a middle portion having a pattern provided and woven therein. The first peripheral layer includes a middle portion having a knitting provided and coupled between the first and the second end portions thereof, for forming a prototype of the woven band. The second peripheral layer is disposed on the first peripheral layer, and the first peripheral layer is disposed and received in the second peripheral layer when the prototype of the woven band is turned inside out.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 2:
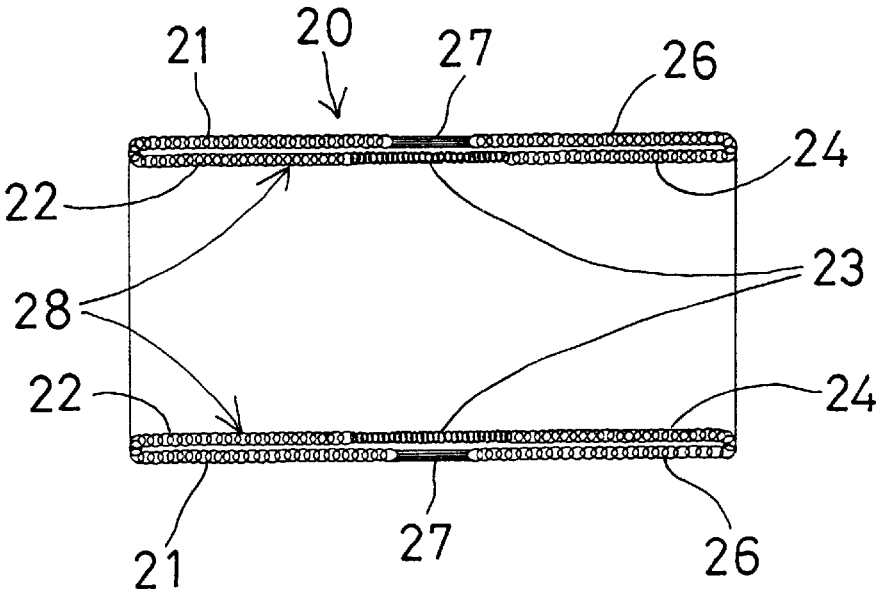
FIG. 2 is a cross sectional view taken along lines 2—2 of FIG. 1.
Figure 1:
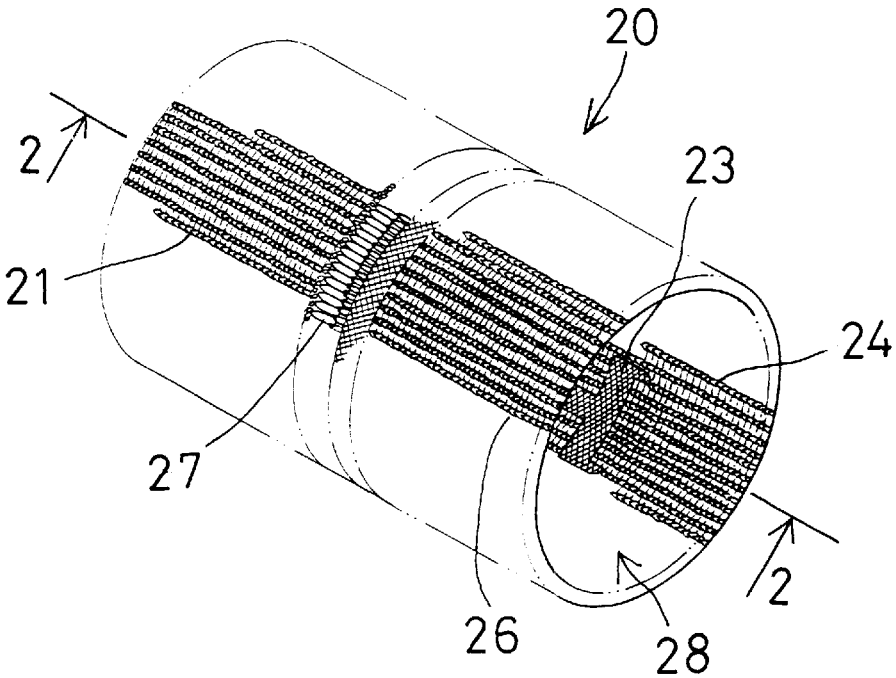
FIG. 1 is a perspective view of a prototype of a woven band in accordance with the present invention.
Figure 3:
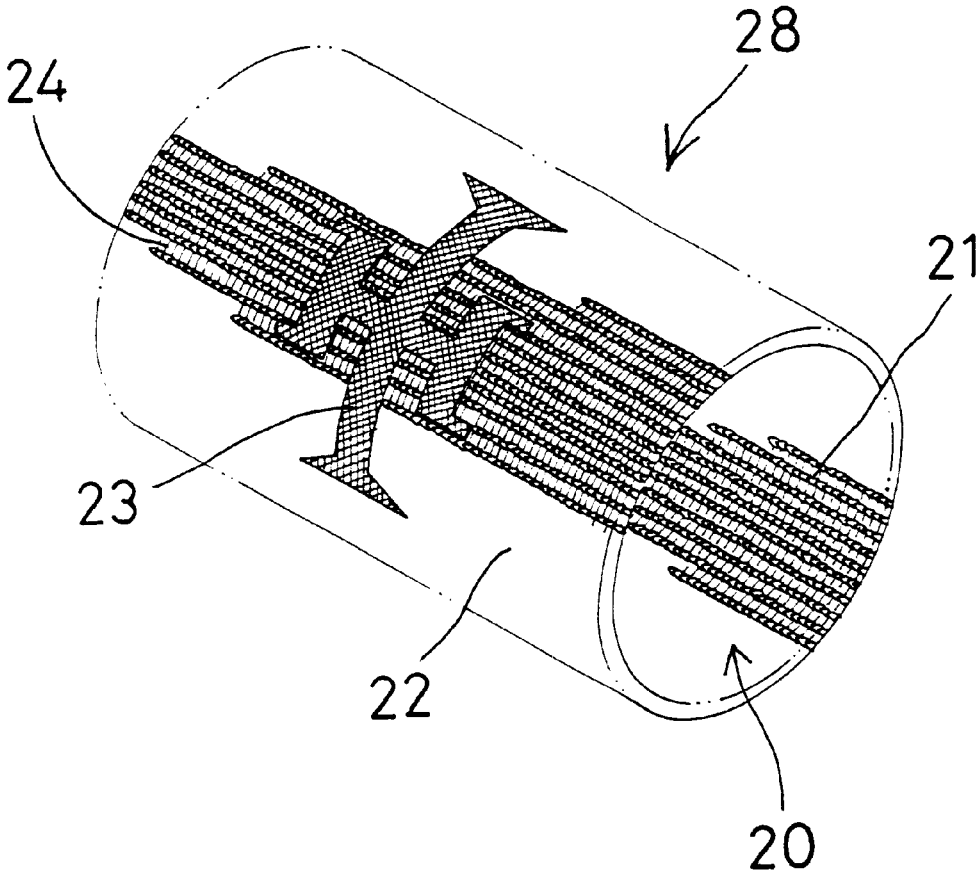
FIG. 3 is a perspective view of the woven band, in which the woven band has been turned inside out from the prototype as shown in FIG. 1.

Referring to the drawings, and initially to FIGS. 1 and 2, a woven band in accordance with the present invention, illustrated is a prototype of the woven band and comprises a first peripheral layer 20 including two halves or two end portions 21, 26, and including a middle portion having a knitting 27 formed or provided therein for coupling the end portions 21, 26 together; and comprises a second peripheral layer 28 having two halves or two end portions 22, 24, and including a middle portion having a knitting or a pattern 23 formed or provided therein for decorative purposes. The pattern 23 may include various kinds of shapes or words or phrases or marks thereon, for example.

In manufacturing the woven band, the first end portion 21 of the first layer 20 is first woven or knitted with a weaving machine (not shown0, which may then weave the first end portion 22 of the second layer 28, and then may weave or form the pattern 23 on the middle portion, and then weave the second end portion 24 of the second layer 28. The weaving machine may then weave the second end portion 26 of the first layer 20. The knitting 27 may then be woven between the end portions 21, 26 of the first layer 20 with the weaving machine, or manually by the workers, in order to couple the end portions 21, 26 of the first layer 20 together, and so as to form the first layer 20 of the woven band, and so as to form the prototype as shown in FIGS. 1 and 2. In the prototype, the first layer 20 is provided on the outer portion, and the second layer 28 is provided in the inner portion of the first layer 20.

After the end portions 21, 26 of the first layer 20 are secured or coupled together with the knitting 27, or after the prototype as shown in FIGS. 1 and 2 has been formed or manufactured, the woven band is then turned inside out, for allowing the second layer 28 and the pattern 23 to be provided on the outer peripheral portion of the woven band, and for allowing the pattern 23 to be exposed and to be seen by people, and for allowing the first layer 20 and the knitting 27 to be received or formed or provided in the inner portion of the woven band. The first layer 20, now, is provided in the inner portion, and the second layer 28 is provided on the outer portion of the first layer 20.

It is to be noted that the first and the second peripheral layers 20, 28 of the woven band may thus include two continuous coupling end portions and include a continuous and beautiful outer appearance, for allowing the woven band to be made in a single weaving process, without cutting and wasting much thread materials. The configuration of the woven band is thus excellent for being manufactured or made in mass production. The woven band may be made into various kinds of sizes or diameters or heights for engaging onto various portions of the users, such as the hands, the wrists, the legs, the ankles, the heads, etc.

Accordingly, the woven band in accordance with the present invention includes an inner and an outer peripheral layers that are not required to be secured together with stitches in the outer end portions, and that include continuous coupling end portions, for allowing the woven band to have a continuous and beautiful outer appearance, and for allowing the woven band to be made in a single weaving process, without cutting and wasting much thread materials.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A woven band comprising:

a first peripheral layer including a first end portion and a second end portion, a second peripheral layer disposed in said first peripheral layer, and including a first end portion and a second end portion, woven and coupled continuously with said first end portion and said second end portion of said first peripheral layer respectively, and including a middle portion having a pattern provided and woven therein, and said first peripheral layer including a middle portion having a knitting provided and coupled between said first and said second end portions thereof, for forming a prototype of said woven band, said second peripheral layer being disposed on said first peripheral layer, and said first peripheral layer being disposed and received in said second peripheral layer when said prototype of said woven band is turned inside out.

* * * * *